US010665189B2

(12) United States Patent
Wang et al.

(10) Patent No.: US 10,665,189 B2
(45) Date of Patent: May 26, 2020

(54) SCAN DRIVING CIRCUIT AND DRIVING METHOD THEREOF, ARRAY SUBSTRATE AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Wei Wang, Beijing (CN); Lingyun Shi, Beijing (CN); Wei Sun, Beijing (CN); Yan Li, Beijing (CN); Chong Liu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/099,925

(22) PCT Filed: Feb. 27, 2018

(86) PCT No.: PCT/CN2018/077398
§ 371 (c)(1),
(2) Date: Nov. 8, 2018

(87) PCT Pub. No.: WO2019/007085
PCT Pub. Date: Jan. 10, 2019

(65) Prior Publication Data

US 2019/0147818 A1 May 16, 2019

(30) Foreign Application Priority Data

Jul. 4, 2017 (CN) ..... 2017 1 0536675

(51) Int. Cl.
*G09G 3/36* (2006.01)
*G09G 5/00* (2006.01)
(Continued)

(52) U.S. Cl.
CPC ..... *G09G 3/3674* (2013.01); *G09G 3/20* (2013.01); *G09G 3/3275* (2013.01);
(Continued)

(58) Field of Classification Search
CPC ... G09G 3/36; G09G 3/30; G09G 5/00; G06F 3/038
See application file for complete search history.

(56) References Cited

U.S. PATENT DOCUMENTS

2016/0171938 A1* 6/2016 Na ..... G09G 3/3688 345/698
2018/0261177 A1* 9/2018 Han ..... G09G 3/3677
(Continued)

FOREIGN PATENT DOCUMENTS

CN 206003477 U 3/2017
CN 106782278 A 5/2017
(Continued)

OTHER PUBLICATIONS

International Search Report of PCT/CN2018/077398 in Chinese, dated May 22, 2018, with English translation.
(Continued)

*Primary Examiner* — Pegeman Karimi
(74) *Attorney, Agent, or Firm* — Collard & Roe, P.C.

(57) ABSTRACT

A scan driving circuit and a driving method thereof, an array substrate and a display device are provided. The scan driving circuit includes a scan signal generating circuit, a plurality of scan lines and a plurality of switching circuits. The scan signal generating circuit includes a plurality of output terminals for respectively outputting scan signals; the plurality
(Continued)

of scan lines respectively correspond to the plurality of output terminals of the scan signal generating circuit and are divided into a plurality of scan line groups, and each of the plurality of scan line groups includes at least two scan lines; the plurality of switching circuits respectively correspond to the plurality of scan line groups and are respectively disposed between the plurality of scan line groups and the plurality of output terminals.

20 Claims, 8 Drawing Sheets

(51) Int. Cl.
*G09G 3/3275* (2016.01)
*G09G 3/20* (2006.01)

(52) U.S. Cl.
CPC ..... *G09G 2310/0218* (2013.01); *G09G 2310/0221* (2013.01); *G09G 2310/0267* (2013.01); *G09G 2310/0283* (2013.01)

(56) References Cited

U.S. PATENT DOCUMENTS

2019/0057666 A1* 2/2019 Zhang ..... G09G 3/3677
2019/0206961 A1* 7/2019 Kim ..... H01L 27/3255

FOREIGN PATENT DOCUMENTS

CN 106887216 A 6/2017
CN 107274822 A 10/2017
KR 20050100208 A 10/2005

OTHER PUBLICATIONS

Notice of Transmittal of the International Search Report of PCT/CN2018/077398 in Chinese, dated May 22, 2018.
Written Opinion of the International Searching Authority of PCT/CN2018/077398 in Chinese, dated May 22, 2018 with English translation.

* cited by examiner

SCAN DRIVING CIRCUIT AND DRIVING METHOD THEREOF, ARRAY SUBSTRATE AND DISPLAY DEVICE

CROSS REFERENCE TO RELATED APPLICATIONS

This application is the National Stage of PCT/CN2018/077398 filed on Feb. 27, 2018, which claims priority under 35 U.S.C. § 119 of Chinese Application No. 201710536675.1 filed on Jul. 4, 2017, the disclosure of which is incorporated by reference.

TECHNICAL FIELD

Embodiments of the present disclosure relate to a scan driving circuit and a driving method thereof, an array substrate and a display device.

BACKGROUND

With the development of display technology and the continuous improvement of user demand, high resolution has become a major feature of products in the display field. In order to improve the resolution, PPI (Pixels Per Inch) in a display substrate is getting larger and larger, and the amount of data that needs to be processed, transmitted and operated is also getting larger and larger, which causes the power consumption of the display product to become larger. On the other hand, when a user uses the display product with a high resolution, it is not necessary for the display product to remain in a high resolution display mode under certain circumstances.

SUMMARY

At least one embodiment of the present disclosure provides a scan driving circuit, including: a scan signal generating circuit, a plurality of scan lines and a plurality of switching circuits. The scan signal generating circuit includes a plurality of output terminals for respectively outputting scan signals; the plurality of scan lines respectively correspond to the plurality of output terminals of the scan signal generating circuit and are divided into a plurality of scan line groups, and each of the plurality of scan line groups includes at least two scan lines; the plurality of switching circuits respectively correspond to the plurality of scan line groups and are respectively disposed between the plurality of scan line groups and the plurality of output terminals; and each of the plurality of switching circuits is configured to enable at least two scan lines of one scan line group corresponding to each of the plurality of switching circuits to be electrically shorted so as to allow the at least two scan lines to be electrically connected to same one of the output terminals, or electrically disconnected from each other so as to allow the at least two scan lines to be respectively electrically connected to different ones of the output terminals.

For example, in a scan driving circuit provided by an embodiment of the present disclosure, each scan line group of the plurality of scan line groups includes two scan lines, correspondingly, each of the plurality of switching circuits includes: a first input terminal, a first output terminal, corresponding to and being connected to the first input terminal, a second input terminal, a second output terminal, corresponding to the second input terminal, a first switch, connected in series between the first input terminal and the second output terminal, and a second switch, connected in series between the second input terminal and the second output terminal. The first input terminal and the second input terminal are respectively connected to one of the plurality of output terminals of the scan signal generating circuit, and the first output terminal and the second output terminal are respectively connected to different one of the two scan lines of the scan line group.

For example, a scan driving circuit provided by an embodiment of the present disclosure further includes a first control signal line and a second control signal line. The first control signal line is connected to a control terminal of the first switch, and the second control signal line is connected to a control terminal of the second switch.

For example, in a scan driving circuit provided by an embodiment of the present disclosure, the first switch includes a first transistor, a first electrode of the first transistor is connected to the first input terminal, a second electrode of the first transistor is connected to the second output terminal, and a gate electrode of the first transistor is connected to the first control signal line and is served as the control terminal of the first switch; and the second switch includes a second transistor, a first electrode of the second transistor is connected to the second input terminal, a second electrode of the second transistor is connected to the second output terminal, and a gate electrode of the second transistor is connected to the second control signal line and is served as a control terminal of the second switch.

For example, in a scan driving circuit provided by an embodiment of the present disclosure, each scan line group of the plurality of scan line groups includes three scan lines, correspondingly, each of the plurality of switching circuits includes: a first input terminal, a first output terminal, corresponding to and being connected to the first input terminal, a second input terminal, a second output terminal, corresponding to the second input terminal, a third input terminal, a third output terminal, corresponding to the third input terminal, a first switch, connected in series between the first input terminal and the second output terminal, a second switch, connected in series between the second input terminal and the second output terminal, a third switch, connected in series between the second output terminal and the third output terminal, and a fourth switch, connected in series between the third input terminal and the third output terminal. The first input terminal, the second input terminal and the third input terminal are respectively connected to one of the plurality of output terminals of the scan signal generating circuit, and the first output terminal, the second output terminal and the third output terminal are respectively connected to different one of the three scan lines of the scan line group.

For example, a scan driving circuit provided by an embodiment of the present disclosure further includes a first control signal line and a second control signal line. The first control signal line is connected to a control terminal of the first switch and a control terminal of the third switch, and the second control signal line is connected to a control terminal of the second switch and a control terminal of the fourth switch.

For example, in a scan driving circuit provided by an embodiment of the present disclosure, the first switch includes a first transistor, a first electrode of the first transistor is connected to the first input terminal, a second electrode of the first transistor is connected to the second output terminal, and a gate electrode of the first transistor is connected to the first control signal line and is served as the control terminal of the first switch; the second switch includes a second transistor, a first electrode of the second transistor is connected to the second input terminal, a second electrode of the second transistor is connected to the second output terminal, and a gate electrode of the second transistor is connected to the second control signal line and is served as the control terminal of the second switch; the third switch includes a third transistor, a first electrode of the third transistor is connected to the second output terminal, a second electrode of the third transistor is connected to the third output terminal, and a gate electrode of the third transistor is connected to the first control signal line and is served as the control terminal of the third switch; and the fourth switch includes a fourth transistor, a first electrode of the fourth transistor is connected to the third input terminal, a second electrode of the fourth transistor is connected to the third output terminal, and a gate electrode of the fourth transistor is connected to the second control signal line and is served as the control terminal of the fourth switch.

For example, in a scan driving circuit provided by an embodiment of the present disclosure, the first control signal line and the second control signal line are electrically connected to each other.

For example, in a scan driving circuit provided by an embodiment of the present disclosure, the scan signal generating circuit includes a GOA circuit, the GOA circuit includes a plurality of cascaded GOA units, and each of the GOA units corresponds to one of the plurality of output terminals.

For example, in a scan driving circuit provided by an embodiment of the present disclosure, the scan signal generating circuit includes a gate driving chip.

At least one embodiment of the present disclosure provides an array substrate, and the array substrate includes the scan driving circuit according to any one of the embodiments of the present disclosure.

At least one embodiment of the present disclosure provides a display device, and the display device includes the scan driving circuit according to any one of the embodiments of the present disclosure.

For example, a display device provided by an embodiment of the present disclosure further includes a display substrate, and in a case where the scan signal generating circuit includes a gate driving chip, the gate driving chip is bonded on the display substrate.

For example, a display device provided by an embodiment of the present disclosure further includes a controller, and the controller is configured to control the plurality of switching circuits.

At least one embodiment of the present disclosure provides a driving method of the scan driving circuit, including: controlling each of the plurality of switching circuits to enable at least two scan lines of one scan line group corresponding to each of the plurality of switching circuits to be electrically shorted so as to allow the at least two scan lines to be electrically connected to same one of the output terminals; and controlling each of the plurality of switching circuits to enable at least two scan lines of one scan line group corresponding to each of the plurality of switching circuits to be electrically disconnected from each other so as to allow the at least two scan lines to be respectively electrically connected to different ones of the output terminals.

At least one embodiment of the present disclosure provides a driving method of the display device, including: controlling each of the plurality of switching circuits to enable at least two scan lines of one scan line group corresponding to each of the plurality of switching circuits to be electrically shorted so as to allow the at least two scan lines to be electrically connected to same one of the output terminals, and enabling part or all of a display region of the display device is in a high resolution mode; and controlling each of the plurality of switching circuits to enable at least two scan lines of one scan line group corresponding to each of the plurality of switching circuits to be electrically from each other so as to allow the at least two scan lines to be respectively electrically connected to different ones of the output terminals, and enabling part or all of the display region of the display device is in a low resolution mode.

BRIEF DESCRIPTION OF THE DRAWINGS

In order to demonstrate clearly technical solutions of the embodiments of the present disclosure, the accompanying drawings in relevant embodiments of the present disclosure will be introduced briefly. It is apparent that the drawings are only related to some embodiments of the disclosure and thus are not intended to limit the present disclosure.

DETAILED DESCRIPTION

Figure 1:
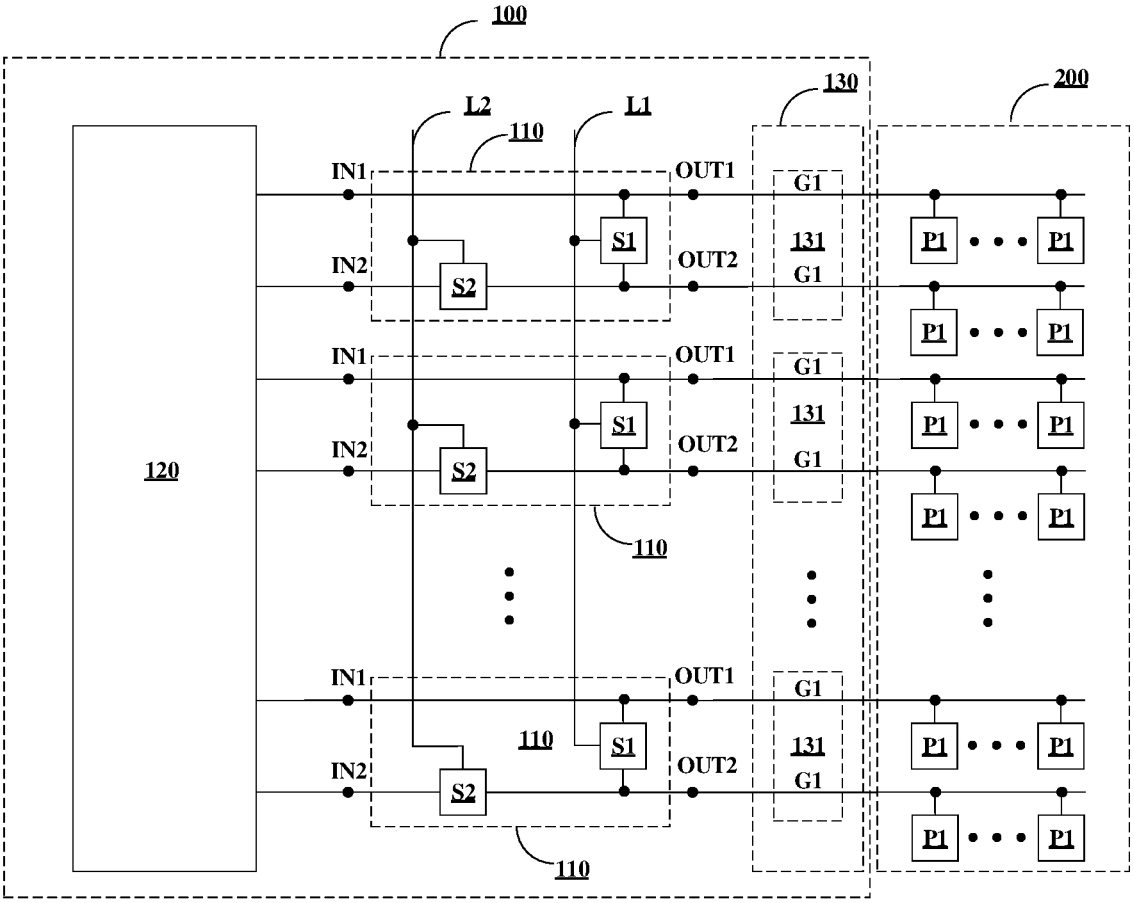
FIG. 1 is a schematic diagram of a scan driving circuit capable of realizing a every two-row scan according to embodiments of the present disclosure.

In order to make objects, technical details and advantages of the embodiments of the disclosure apparent, the technical solutions of the embodiment will be described in a clearly and fully understandable way in connection with the drawings related to the embodiments of the disclosure. It is apparent that the described embodiments are just a part but not all of the embodiments of the disclosure. Based on the described embodiments herein, those skilled in the art can obtain other embodiment, without any creative work, which shall be within the scope of the disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present disclosure, are not intended to indicate any sequence, amount or importance, but for distinguishing various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

At least one embodiment of the present disclosure provides a scan driving circuit, including: a scan signal generating circuit, a plurality of scan lines and a plurality of switching circuits. The scan signal generating circuit includes a plurality of output terminals for respectively outputting scan signals; the plurality of scan lines respectively correspond to the plurality of output terminals of the scan signal generating circuit and are divided into a plurality of scan line groups, and each of the plurality of scan line groups includes at least two scan lines; the plurality of switching circuits respectively correspond to the plurality of scan line groups and are respectively disposed between the plurality of scan line groups and the plurality of output terminals; and each of the plurality of switching circuits is configured to enable at least two scan lines of one scan line group corresponding to each of the plurality of switching circuits to be electrically shorted so as to allow the at least two scan lines to be electrically connected to same one of the output terminals, or electrically disconnected from each other so as to allow the at least two scan lines to be respectively electrically connected to different ones of the output terminals. At least one embodiment of the present disclosure further provides a driving method, an array substrate and a display device corresponding to the above-described scan driving circuit.

The resolution of the display device using a conventional scan driving circuit is fixed, the resolution cannot be adjusted according to actual needs, and selective driving cannot be realized in different regions of the display device. The scan driving circuit and the driving method thereof, the array substrate and the display device provided by the embodiments of the present disclosure can change display resolution and selectively drive the different regions of the display device with different resolutions, thereby reducing the display power consumption.

Hereinafter, the embodiments of the present disclosure and examples thereof will be described in detail with reference to the drawings.

At least one embodiment of the present disclosure provides a scan driving circuit 100, as shown in FIG. 1, the scan driving circuit 100 includes a scan signal generating circuit 120, a plurality of scan lines 130, and a plurality of switching circuits 110.

Figure 3:
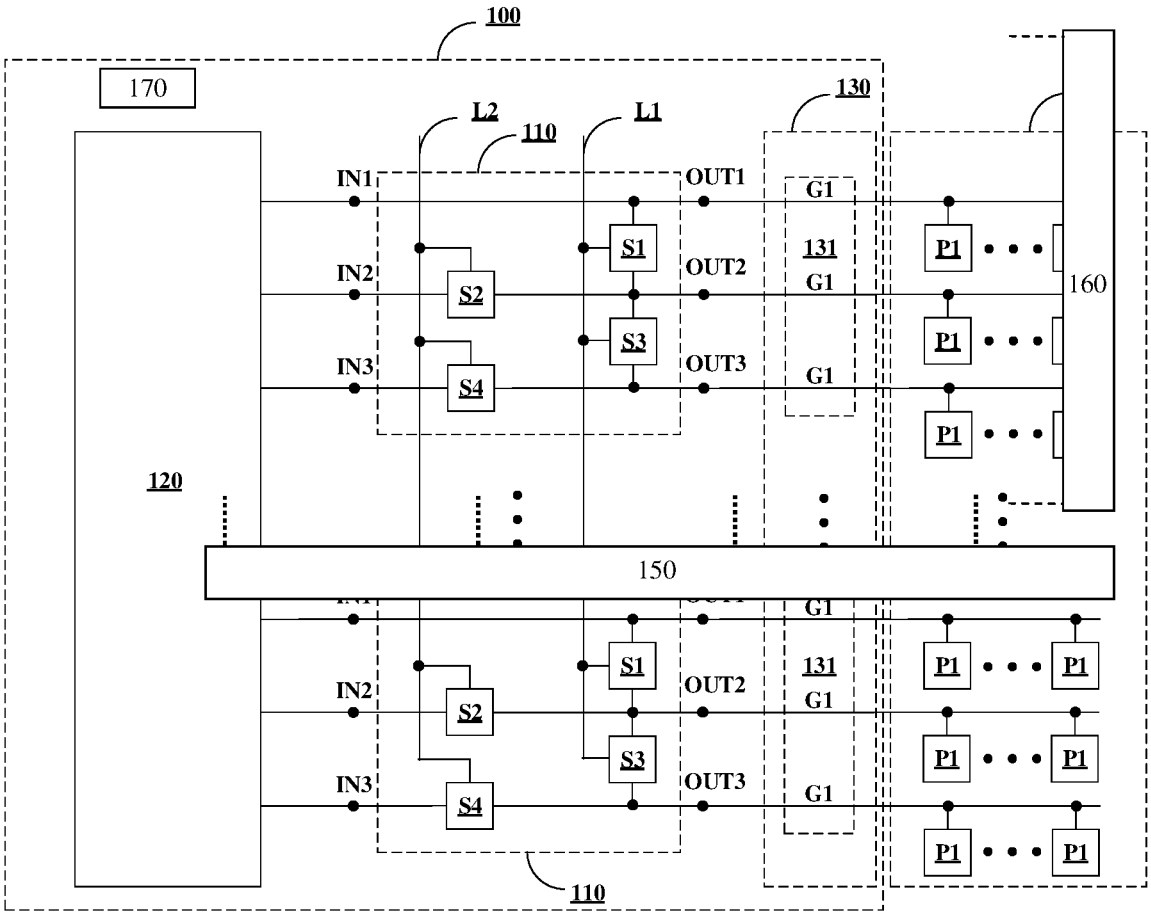
FIG. 3 is a schematic diagram of a scan driving circuit capable of realizing a every three-row scan according to embodiments of the present disclosure.

For example, as shown in FIG. 1 and FIG. 3, the scan signal generating circuit 120 includes a plurality of output terminals for respectively outputting scan signals, for example, outputting scan driving signals row by row. The plurality of scan lines 130 respectively correspond to the plurality of output terminals of the scan signal generating circuit 120 and are divided into a plurality of scan line groups 131, and each of the plurality of scan line groups includes at least two scan lines G1. For example, as shown in FIG. 1, each of the plurality of scan line groups 131 includes two scan lines G1. For another example, as shown in FIG. 3, each of the plurality of scan line groups 131 includes three scan lines G1. It should be noted that the embodiments of the present disclosure include but are not limited thereto. For example, each of the plurality of scan line groups can further includes four or more scan lines G1.

It will be readily understand that in order to realize a progressive-scan function, the number of the scan lines G1 should be set to coincide with the number of the output terminals of the scan signal generating circuit 120, that is, the plurality of scan lines 130 respectively correspond to the plurality of output terminals of the scan signal generating circuit 120, and the scan lines 130 and the output terminals of the scan signal generating circuit 120 maintain a one-to-one correspondence.

For example, as shown in FIG. 1 and FIG. 3, a switching circuit 110 is disposed between each of the plurality of scan line groups 131 and the output terminals of the scan signal generating circuit 120 corresponding to the scan line group 131. Each of the plurality of switching circuits 110 corresponds to a scan line group 131, that is, the number of the plurality of switching circuits 110 is set to coincide with the number of the plurality of scan line groups 131.

An embodiment of the present disclosure provides a scan driving circuit 100, as shown in FIG. 1. Each of the plurality of switching circuits 110 is configured to enable two scan lines G1 of one scan line groups 131 corresponding to each of the plurality of switching circuits 110 to be electrically shorted so as to allow the at least two scan lines G1 to be electrically connected to same one of the output terminals of the scan signal generating circuit 120, or electrically disconnected from each other so as to allow the two scan lines G1 to be respectively electrically connected to different ones of the output terminals of the scan signal generating circuit 120.

For example, as shown in FIG. 1, the scan driving circuit 100 can be connected to a plurality of pixel units P1 in a pixel region 200 of an array substrate so as to supply scan driving signals to the pixel units P1. For example, each of the plurality of scan lines G1 is connected to a row of pixel units P1 for driving the row of pixel units P1. For example, the pixel units P1 of a same column can share a same data line (not shown in FIG. 1), that is, the pixel units P1 of the same column are connected to the same data line.

In a high resolution mode, each of the plurality of switching circuits 110 is configured to enable two scan lines G1 of one scan line group 131 corresponding to each of the plurality of switching circuits 110 to be electrically disconnected from each other so as to allow the two scan lines G1 to be respectively electrically connected to different ones of the output terminals of the scan signal generating circuit 120. The pixel units P1 of a (2n−1)th row and a (2n)th row of a same column are sequentially turned on in response to progressive-scan driving signals outputted from two different output terminals of the scan signal generating circuit 120, that is, scanning row by row. At this time, the pixel units P1 of the (2n−1)th row and the (2n)th row display different image pixels, thereby maintaining the high resolution displayed by the array substrate itself. It should be noted that n is an integer greater than zero, and the following embodiments are the same in this aspect and will not be described again.

In a low resolution mode, each of the plurality of switching circuits 110 is configured to enable the two scan lines G1 of one scan line group 131 corresponding to each of the plurality of switching circuits 110 to be electrically shorted so as to allow the two scan lines G1 to be electrically connected to same one of the output terminals of the scan signal generating circuit 120. The pixel units P1 of the (2n−1)th row and the (2n)th row of a same column are simultaneously turned on in response to the scan driving signal outputted by a same output terminal of the scan signal generating circuit 120, that is, if the pixel units P1 of the (2n−1)th row and the (2n)th row of the same column are connected to the same data line, then they will receive same data signal. Corresponding to a progressive-scan mode, this method is referred to as a every two-row scan mode, in this case, the pixel units P1 of the (2n−1)th row and the (2n)th row display same image pixels, thereby reducing the display resolution of the display device adopting the array substrate, which is reduced to half of the original display resolution.

It should be noted that the methods above-mentioned adjust a vertical resolution. For data lines, each column of the pixel units are connected to a same data line. For example, when data signals are input to each column of data lines, a horizontal resolution remains unchanged. For another example, when the odd columns (or even columns) of data lines input data signals, and the remaining even columns (or odd columns) of data lines do not input image data signals, the horizontal resolution becomes ½ of the original horizontal resolution. It should be noted that in this case, the data lines without inputting the image data signals can input a low voltage to keep its corresponding pixel units in a black state. Alternatively, it is also possible to combine two pixels adjacent in a lateral direction, that is, inputting the same image data signals.

Normally, if the vertical resolution is adjusted to ½ of the original vertical resolution, for example, switching from the progressive-scan mode to every two-row scan mode. The corresponding horizontal resolution should also be adjusted to ½ of the original horizontal resolution, so as to ensure that the horizontal resolution and the vertical resolution are matched.

For example, the low resolution mode is a HD (1280*720) mode and the high resolution mode is a QHD (2560*1440) mode. The embodiments of the present disclosure include but are not limited thereto.

For example, in a scan driving circuit 100 provided by another embodiment of the present disclosure, as shown in FIG. 3. Each of the plurality of switching circuits 110 is configured to enable three scan lines G1 of one scan line groups 131 corresponding to each of the plurality of switching circuits 110 to be electrically shorted so as to allow the three scan lines G1 to be electrically connected to same one of the output terminals of the scan signal generating circuit 120, or electrically disconnected from each other so as to allow the three scan lines G1 to be respectively electrically connected to different ones of the output terminals of the scan signal generating circuit 120.

For example, as shown in FIG. 3, the scan driving circuit 100 can be connected to a plurality of pixel units P1 in a pixel region 200 of an array substrate so as to supply scan driving signals to the pixel units P1. For example, each of the plurality of scan lines G1 is connected to a row of pixel units P1 for driving the row of pixel units P1. For example, the pixel units P1 of a same column can share a same data line (not shown in FIG. 3), that is, the pixel units P1 of the same column are connected to the same data line.

In a high resolution mode, each of the plurality of switching circuits 110 is configured to enable three scan lines G1 of one scan line group 131 corresponding to each of the plurality of switching circuits 110 to be electrically disconnected from each other so as to allow the three scan lines G1 to be respectively electrically connected to different ones of the output terminals of the scan signal generating circuit 120. The pixel units P1 of a (3n−2)th row, a (3n−1)th row and a (3n)th row of a same column are sequentially turned on in response to progressive-scan driving signals outputted from three different output terminals of the scan signal generating circuit 120, that is, scanning row by row. At this time, the pixel units P1 of the (3n−2)th row, the (3n−1)th row and the (3n)th row display different image pixels, thereby maintaining the high resolution displayed by the array substrate itself.

In a low resolution mode, each of the plurality of switching circuits 110 is configured to enable the three scan lines G1 of one scan line group 131 corresponding to each of the plurality of switching circuits 110 to be electrically shorted so as to allow the three scan lines G1 to be electrically connected to same one of the output terminals of the scan signal generating circuit 120. The pixel units P1 of the (3n−2)th row, the (3n−1)th row and the (3n)th row of a same column are simultaneously turned on in response to the scan driving signal outputted by a same output terminal of the scan signal generating circuit 120, that is, the pixel units P1 of the (3n−2)th row, the (3n−1)th row and the (3n)th row of a same column receive same data signals. Corresponding to the progressive-scan mode, this method is referred to as a every three-row scan mode, in this case, the pixel units P1 of the (3n−2)th row, the (3n−1)th row and the (3n)th row display same image pixels, thereby reducing the display resolution of the display device adopting the array substrate.

The descriptions of the vertical resolution and the horizontal resolution can refer to the corresponding descriptions in the embodiments above-mentioned, and details are not described here again. It should be noted that those skilled in the art can easily think of a every four-rows scan mode and the like in addition to the every two-row scan mode and the every three-row scan mode described in the embodiments of the present disclosure without requiring creative labor, and these implementations are also within the scope of the present disclosure.

The scan driving circuits provided by the embodiments of the present disclosure can adjust the resolution of the display according to actual needs. When it is necessary to maintain the high resolution display, switching to the progressive-scan mode by the switching circuits, that is, switching to the high resolution mode. When the high resolution display is not required, switching to a multi-rows scan mode (for example, the every two-row scan mode, the every three-row scan mode and the like), that is, switching to the low resolution mode, thereby reducing the display power consumption.

In a scan driving circuit 100 provided by an embodiment of the present disclosure, as shown in FIG. 1, each of the plurality of scan line groups 131 includes two scan lines G1, correspondingly, each of the plurality of switching circuits 110 includes: a first input terminal IN1, a first output terminal OUT1 corresponding to and being connected to the first input terminal IN1, a second input terminal IN2, a second output terminal OUT2 corresponding to the second input terminal IN2, a first switch S1 being connected in series between the first input terminal IN1 and the second output terminal OUT2, and a second switch S2 being connected in series between the second input terminal IN2 and the second output terminal OUT2.

The first input terminal IN1 and the second input terminal IN2 are respectively connected to one of the plurality of output terminals of the scan signal generating circuit 120. For example, the first input terminal IN1 is connected to a (2N−1)th output terminal of the scan signal generating circuit 120. For example, the second input terminal IN2 is connected to a (2N)th output terminal of the scan signal generating circuit 120. The first output terminal OUT1 and the second output terminal OUT2 are respectively connected to different one of the two scan lines of the scan line group 131. It should be noted that N is an integer greater than zero, and the following embodiments are the same in this aspect and will not be described again.

For example, as shown in FIG. 1, the scan driving circuit 100 can further include a first control signal line L1 and a second control signal line L2. The first control signal line L1 is connected to a control terminal of the first switch S1 in each switching circuit 110, for example, the first control signal line L1 is used to control the first input terminal IN1 and the second output terminal OUT2 in each switching circuit 110 to be connected or disconnected. The second control signal line L2 is connected to a control terminal of the second switch S2 in each switching circuit 110, for example, the second control signal line L2 is used to control the second input terminal IN2 and the second output terminal OUT2 in each switching circuit 110 to be connected or disconnected.

The first switch S1 and the second switch S2 in each switching circuit 110 cooperate to realize switching of the connection manner between the two scan lines G1 of the corresponding scan line group 131 and the output terminals of the scan signal generating circuit 120. For example, when the S1 is opened and the S2 is closed, the two scan lines G1 in the scan line group 131 are respectively electrically connected to two different output terminals of the scan signal generating circuit 120. For another example, when the S1 is closed and the S2 is opened, the two scan lines G1 in the scan line group 131 are electrically connected to a same output terminal of the scan signal generating circuit 120.

Figure 2:
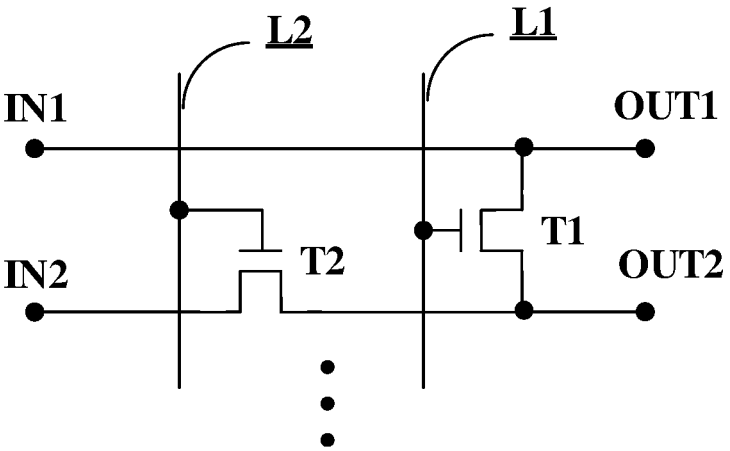
FIG. 2 is a schematic diagram of a switching circuit including two transistor switches according to embodiments of the present disclosure.

For example, as shown in FIG. 2, the first switch S1 in each switching circuit 110 can be a first transistor T1, a first electrode of the first transistor T1 is connected to the first input terminal IN1, a second electrode of the first transistor T1 is connected to the second output terminal OUT2, and a gate electrode of the first transistor T1 is connected to the first control signal line L1 and is served as the control terminal of the first switch S1.

The second switch S2 in each switching circuit 110 can be a second transistor T2, a first electrode of the second transistor T2 is connected to the second input terminal IN2, the second electrode of the second transistor T2 is connected to the second output terminal OUT2, and a gate electrode of the second transistor T2 is connected to the second control signal line L2 and is served as the control terminal of the second switch S2.

For example, the first transistor T1 and the second transistor T2 can be a same type of transistor. For example, in the high resolution mode, the first control signal line L1 provides a low level, and the first transistor T1 is turned off; and the second control signal line L2 provides a high level, the second transistor T2 is turned on, thereby implementing the progressive-scan mode.

For example, in the low resolution mode, the first control signal line L1 provides a high level, and the first transistor T1 is turned on; and the second control signal line L2 provides a low level, the second transistor T2 is turned off, thereby implementing the every two-row scan mode.

For example, in a scan driving circuit 100 provided by another embodiment of the present disclosure, as shown in FIG. 3, each scan line group 131 includes three scan lines G1, correspondingly, each switching circuit 110 includes: a first input terminal IN1, a first output terminal OUT1 corresponding to and being connected to the first input terminal IN1, a second input terminal IN2, a second output terminal OUT2 corresponding to the second input terminal IN2, a third input terminal IN3, a third output terminal OUT3 corresponding to the third input terminal IN3, a first switch S1 being connected in series between the first input terminal IN1 and the second output terminal OUT2, a second switch S2 being connected in series between the second input terminal IN2 and the second output terminal OUT2, a third switch S3 being connected in series between the second output terminal OUT2 and the third output terminal OUT3, and a fourth switch S4 being connected in series between the third input terminal IN3 and the third output terminal OUT3.

The first input terminal IN1, the second input terminal IN2 and the third input terminal IN3 are respectively connected to one of the plurality of output terminals of the scan signal generating circuit 120. For example, the first input terminal IN1 is connected to a (3N−2)th output terminal of the scan signal generating circuit 120; the second input terminal IN2 is connected to a (3N−1)th output terminal of the scan signal generating circuit 120; and the third input terminal IN3 is connected to a (3N)th output terminal of the scan signal generating circuit 120. The first output terminal OUT1, the second output terminal OUT2 and the third output terminal OUT3 are respectively connected to different one of the three scan lines of the scan line group 131.

For example, as shown in FIG. 3, the scan driving circuit 100 can further include a first control signal line L1 and a second control signal line L2. The first control signal line L1 is connected to a control terminal of the first switch S1 and a control terminal of the third switch S3 in each switching circuit 110, for example, the first control signal line L1 is used to control the first input terminal IN1 and the second output terminal OUT2 in each switching circuit 110 to be connected or disconnected, and control the second output terminal OUT2 and the third output terminal OUT3 in each switching circuit 110 to be connected or disconnected. The second control signal line L2 is connected to a control terminal of the second switch S2 and a control terminal of the fourth switch S4 in each switching circuit 110, for example, the second control signal line L2 is used to control the second input terminal IN2 and the second output terminal OUT2 in each switching circuit 110 to be connected or disconnected, and control the third input terminal IN3 and the third output terminal OUT3 in each switching circuit 110 to be connected or disconnected.

The first switch S1, the second switch S2, the third switch S3 and the fourth switch S4 in each switching circuit 110 cooperate to realize switching of the connection manner between the three scan lines G1 of the corresponding scan line group 131 and the output terminals of the scan signal generating circuit 120. For example, when the S1 and the S3 are opened and the S2 and the S4 are closed, the three scan lines G1 in the scan line group 131 are respectively electrically connected to three different output terminals of the scan signal generating circuit 120. For another example, when the S1 and the S3 are closed and the S2 and the S4 are opened, the three scan lines G1 in the scan line group 131 are electrically connected to a same output terminal of the scan signal generating circuit 120.

Figure 4:
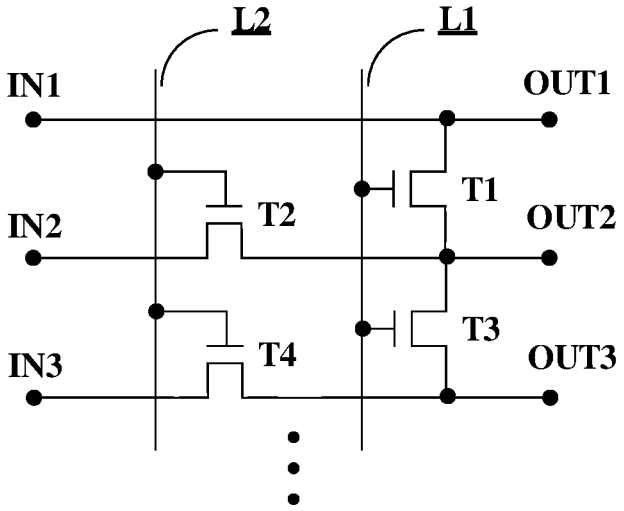
FIG. 4 is a schematic diagram of a switching circuit including four transistor switches according to embodiments of the present disclosure.

For example, as shown in FIG. 4, the first switch S1 in each switching circuit 110 can be a first transistor T1, a first electrode of the first transistor T1 is connected to the first input terminal IN1, a second electrode of the first transistor T1 is connected to the second output terminal OUT2, and a gate electrode of the first transistor T1 is connected to the first control signal line L1 and is served as the control terminal of the first switch S1.

The second switch S2 in each switching circuit 110 can be a second transistor T2, a first electrode of the second transistor T2 is connected to the second input terminal IN2, the second electrode of the second transistor T2 is connected to the second output terminal OUT2, and a gate electrode of the second transistor T2 is connected to the second control signal line L2 and is served as the control terminal of the second switch S2.

The third switch S3 in each switching circuit 110 can be a third transistor T3, a first electrode of the third transistor T3 is connected to the second output terminal OUT2, the second electrode of the third transistor T3 is connected to the third output terminal OUT3, and a gate electrode of the third transistor T3 is connected to the first control signal line L1 and is served as the control terminal of the third switch S3.

The fourth switch S4 in each switching circuit 110 can be a fourth transistor T4, a first electrode of the fourth transistor T4 is connected to the third input terminal IN3, the second electrode of the fourth transistor T4 is connected to the third output terminal OUT3, and a gate electrode of the fourth transistor T4 is connected to the second control signal line L2 and is served as the control terminal of the fourth switch S4.

For example, the first transistor T1 and the second transistor T2 can be a same type of transistor. For example, in the high resolution mode, the first control signal line L1 provides a low level, and the first transistor T1 and the third transistor T3 are turned off; and the second control signal line L2 provides a high level, the second transistor T2 and the fourth transistor T4 are turned on, thereby implementing the progressive-scan mode.

For example, in the low resolution mode, the first control signal line L1 provides a high level, and the first transistor T1 and the third transistor T3 are turned on; and the second control signal line L2 provides a low level, the second transistor T2 and the fourth transistor T4 are turned off, thereby implementing the every three-row scan mode.

It should be noted that all the transistors adopted in the embodiments of the present disclosure can be thin film transistors, field-effect transistors or other switching devices with the same characteristics. A source electrode and a drain electrode of the transistor adopted herein can be symmetrical in structure, so the source electrode and the drain electrode of the transistor can have no difference in structure. In the embodiments of the present disclosure, in order to distinguish the two electrodes of the transistor except the gate electrode, one electrode is directly described as the first electrode and the other electrode is directly described as the second electrode, so the first electrode and the second electrode of all or part of the transistors in the embodiments of the present disclosure can be exchanged as required. For example, the first electrode of the transistor in the embodiments of the present disclosure can be the source electrode, and the second electrode can be the drain electrode; or the first electrode of the transistor is the drain electrode, and the second electrode is the source electrode.

In addition, the transistors can be divided into N-type transistors or P-type transistors according to characteristics of the transistors. If a transistor is a P-type transistor, turn-on voltage of the transistor is a low-level voltage (for example, 0V), and turn-off voltage of the transistor is a high-level voltage (for example, 5V), If a transistor is an N-type transistor, turn-on voltage of the transistor is a high-level voltage (for example, 5V), and turn-off voltage of the transistor is a low-level voltage (for example, 0V). In the embodiment of the present disclosure, describing by taking all of the first transistor T1, the second transistor T2, the third transistor T3 and the fourth transistor T4 as N-type transistor as an example. Based on descriptions and teachings of the implementation of the present disclosure, those skilled in the art can easily think of that embodiments of the present disclosure can adopt P-type transistors or an implementation of a combination of N-type and P-type transistors without creative efforts. Therefore, the above-described implementations are also within the scope of the present disclosure.

As described above, as shown in FIG. 2 and FIG. 4, if the types of the respective transistors are same, the control signals applied on the first control signal line L1 and the second control signal line L2 are synchronized, but the levels of the control signals are opposite to each other, and the first control signal line L1 and the second control signal line L2 can be connected to different control signal output terminals (for example, signal output terminals of a driving circuit).

Figure 5A:
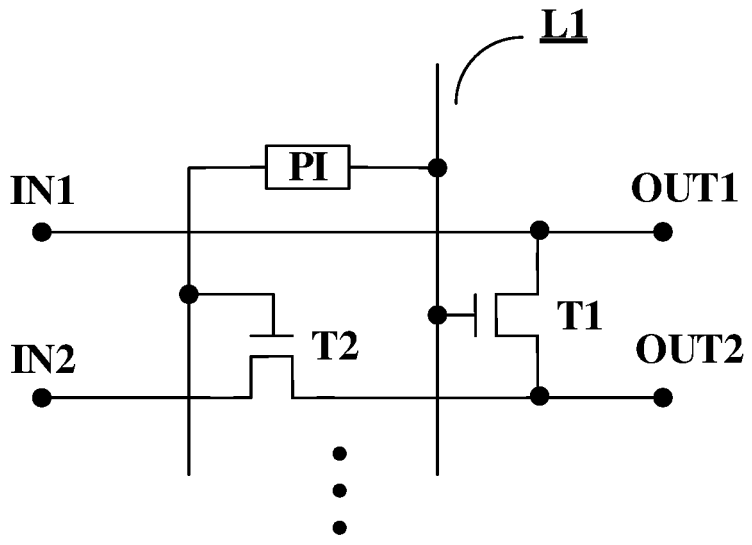
FIG. 5A is a schematic diagram of a modified example of the switching circuit as shown in FIG. 2.
Figure 5B:
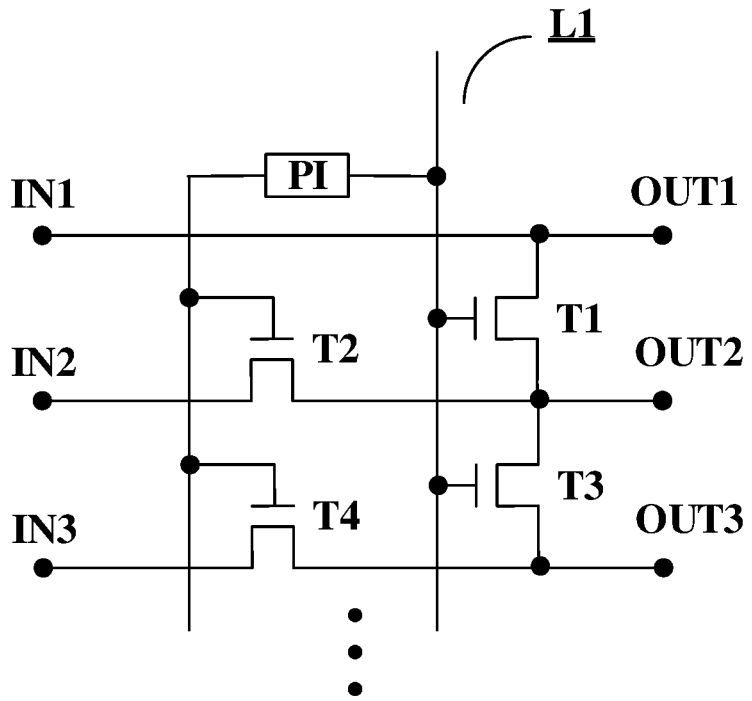
FIG. 5B is a schematic diagram of a modified example of the switching circuit as shown in FIG. 4.

Alternatively, for the examples as shown in FIG. 2 and FIG. 4, the first control signal line L1 and the second control signal line L2 can be connected to a same signal output terminal, but one of the first control signal line L1 and the second control signal line L2 is connected to the signal output terminal by, for example, an inverting circuit. That is, the operation of the switching circuit can be implemented by a control signal line plus an inverting circuit, for example, as shown in FIG. 5A and FIG. 5B (P1 is the inverting circuit). For example, as shown in FIG. 5A, the gate electrode of the first transistor T1 is directly connected to the first control signal line L1, and the gate electrode of the second transistor T2 is connected to the first control signal line L1 through the inverting circuit P1. It will be readily understood that, in FIG. 5A, the gate electrode of the second transistor T2 can also be directly connected to the first control signal line L1, and the gate electrode of the first transistor T1 is connected to the first control signal line L1 through the inverting circuit P1. The setting method of the inverting circuit P1 in FIG. 5B is same as that in FIG. 5A, and details are not described here again.

Figure 6A:
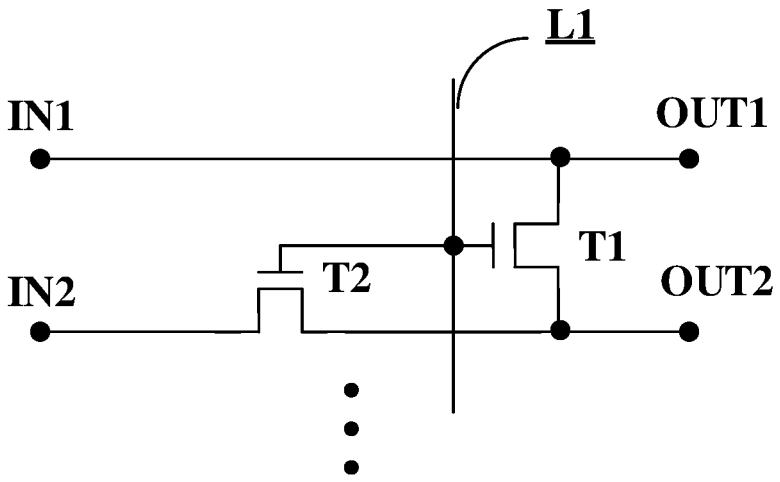
FIG. 6A is a schematic diagram of another modified example of the switching circuit as shown in FIG. 2.

Still alternatively, if the types of transistors are different, for example, for the example as shown in FIG. 2, the first transistor T1 and the second transistor T2 are different types of transistors, that is, one is N-type and the other is P-type. Then the first control signal line L1 can be electrically connected to the second control signal line L2, that is, the gate electrode of the first transistor T1 and the gate electrode of the second transistor T2 are simultaneously connected to one control signal line, for example, the first control signal line L1 (as shown in FIG. 6A). Certainly, the gate electrode of the first transistor T1 and the gate electrode of the second transistor T2 can be connected to the second control signal line L2. In this case, the function of the switching circuit can be implemented by a control signal line, that is, the control signal line is connected to a signal output terminal.

Figure 6B:
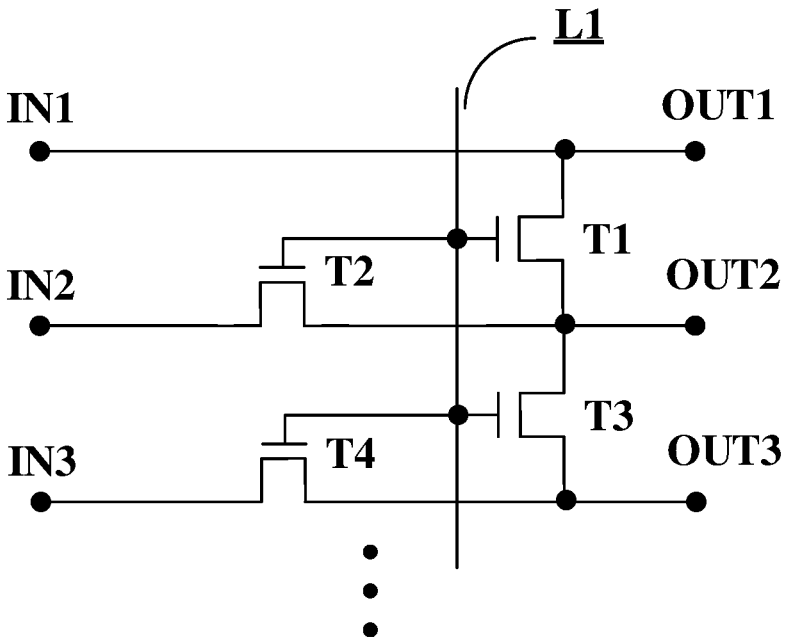
FIG. 6B is a schematic diagram of another modified example of the switching circuit as shown in FIG. 4.

Similarly, for the example as shown in FIG. 4, if the first transistor T1 and the third transistor T3 are of a same type and are one of the N-type and the P-type, the second transistor T2 and the fourth transistor T4 are of a same type and are the other of the N-type and the P-type, then the first control signal line L1 and the second control signal line L2 can be electrically connected. That is, the gate electrodes of the first transistor T1, the second transistor T2, the third transistor T3 and the fourth transistor T4 are simultaneously connected to one control signal line, for example, the first control signal line L1 (as shown in FIG. 6B). Certainly, the gate electrodes of the first transistor T1, the second transistor T2, the third transistor T3 and the fourth transistor T4 can be connected to the second control signal line L2. In this case, the function of the switching circuit can be implemented by a control signal line, that is, the control signal line is connected to a signal output terminal.

Figure 7:
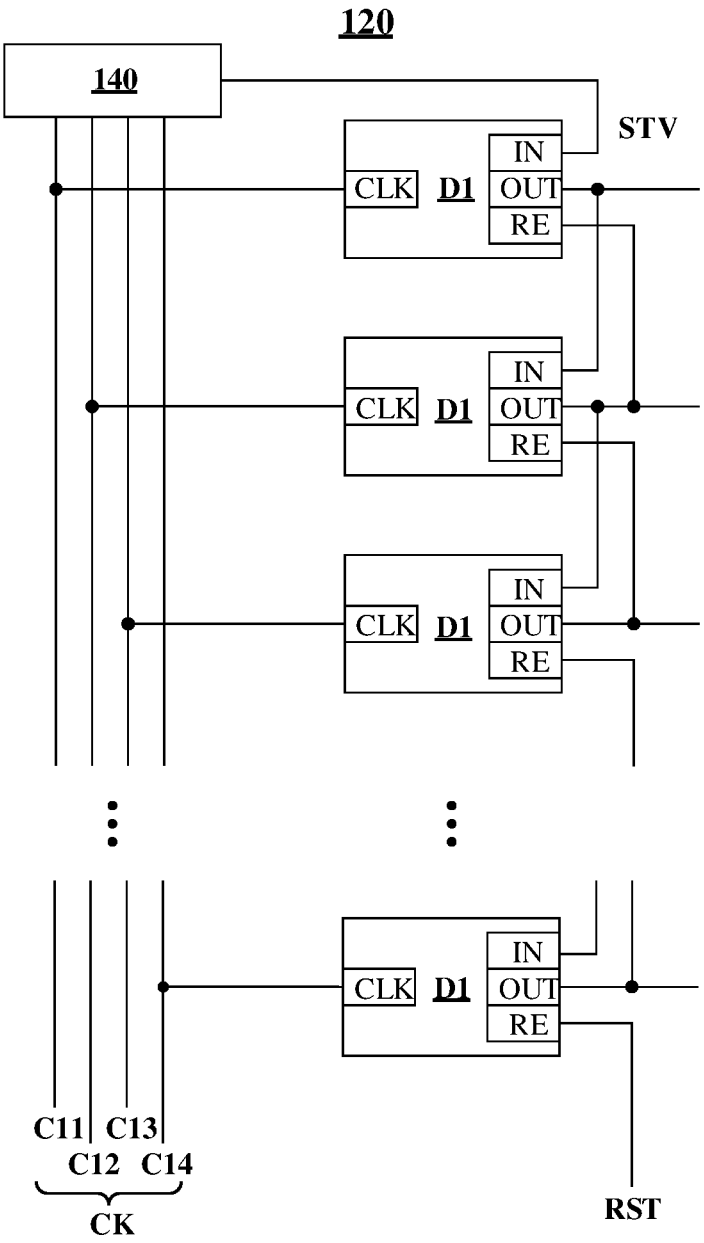
FIG. 7 is a schematic diagram of a GOA circuit in a scan driving circuit according to embodiments of the present disclosure.

In at least one embodiment of the present disclosure, as shown in FIG. 7, the scan signal generating circuit 120 can be a GOA (Gate-driver on Array) circuit. For example, the GOA circuit includes a plurality of cascaded GOA units DE The GOA circuit is directly fabricated on the array substrate by adopting the same processes similar to those for forming a thin film transistor (TFT), and can realize a function of performing display row by row.

For example, as shown in FIG. 7, except the first-stage GOA unit, an input terminal IN of the present-stage GOA unit D1 is connected to an output terminal OUT of the previous-stage GOA unit DE Except the last-stage GOA unit, a reset terminal RE of the present-stage GOA unit D1 is connected to the output terminal OUT of the next-stage GOA unit DE For example, the input terminal IN of the first-stage GOA unit D1 can be configured to receive a trigger signal STV, and the reset terminal RE of the last-stage GOA unit D1 can be configured to receive a reset signal RST.

For example, as shown in FIG. 7, each of the GOA units D1 is configured to output progressive-scan driving signals in response to clock signals CK. For example, the clock signals CK can include signals C11, C12, C13 and C14 which are sequentially arranged in time series and are outputted through different clock signal lines.

For example, as shown in FIG. 7, the GOA circuit can further include a timing controller 140. The timing controller 140 is configured to provide the clock signals CK to each stage of the GOA units D1, and the timing controller 140 can also be configured to provide the trigger signal STV and the reset signal RST.

For example, as shown in FIG. 7, the timing controller 140 is configured to provide the clock signals CK to each of the GOA units D1 through four clock signal lines. The GOA unit D1 of the (4m−3)th stage is configured to receive the signal C11 of the clock signals CK; the GOA unit D1 of the (4m−2)th stage is configured to receive the signal C12 of the clock signals CK; the GOA unit D1 of the (4m−1)th stage is configured to receive the signal C13 of the clock signals CK; and the GOA unit D1 of the 4mth stage is configured to receive the signal C14 of the clock signals CK, and m is an integer greater than zero.

It should be noted that the embodiments of the present disclosure include but are not limited to the case as shown in FIG. 7, the timing controller 140 can also be configured to provide the clock signals CK to the GOA units D1 through two, six, eight or more clock signal lines, and details are not described here again.

In at least one embodiment of the present disclosure, the scan signal generating circuit 120 can also be implemented as a gate driving chip, and the gate driving chip is bonded to be mounted on a display substrate including the scan driving circuit, thereby being connected to the switching circuits, the scan lines and the like. For example, the gate driving chip is connected to the switching circuits, the scan lines and the like through a flexible printed circuit board. The display substrate can be an array substrate, or can be other types of substrates, as long as the gate driving chip can be connected to the switching circuits, the scanning lines and the like, thereby combining them to obtain the scan driving circuits of the embodiments of the present disclosure.

The scan driving circuits provided by the embodiments of the present disclosure can adjust the resolution of the display according to actual needs. When it is necessary to maintain the high resolution display, switching to the progressive-scan mode by the switching circuits, that is, switching to the high resolution mode. When the high resolution display is not required, switching to the multi-rows scan mode (for example, the every two-row scan mode, the every three-row scan mode and the like), that is, switching to the low resolution mode, thereby reducing the display power consumption.

At least one embodiment of the present disclosure provides an array substrate, and the array substrate includes any one of the scan driving circuits according to the embodiments of the present disclosure.

Figure 8:
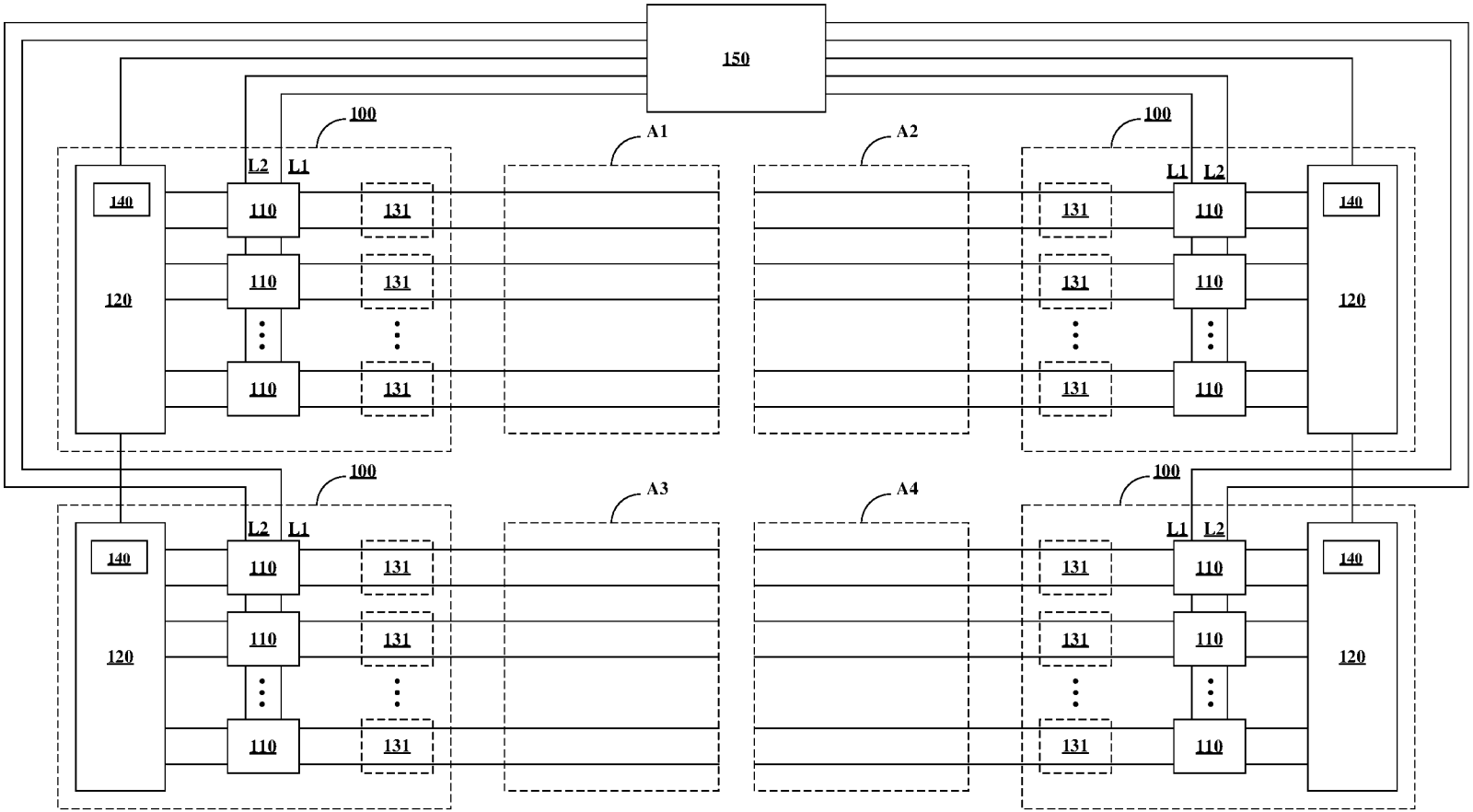
FIG. 8 is a schematic diagram of a display device capable of displaying different regions with different resolutions according to embodiments of the present disclosure.

For example, as shown in FIG. 8, a display region of the array substrate can be divided into four display regions, namely: A1 (upper left region), A2 (upper right region), A3 (lower left region) and A4 (lower right region). Four scan driving circuits 100 are disposed in the array substrate, and each scan driving circuit 100 is respectively connected to pixel units of the four display regions, thereby the display resolutions of the four display regions can be individually adjusted as needed.

Figure 9:
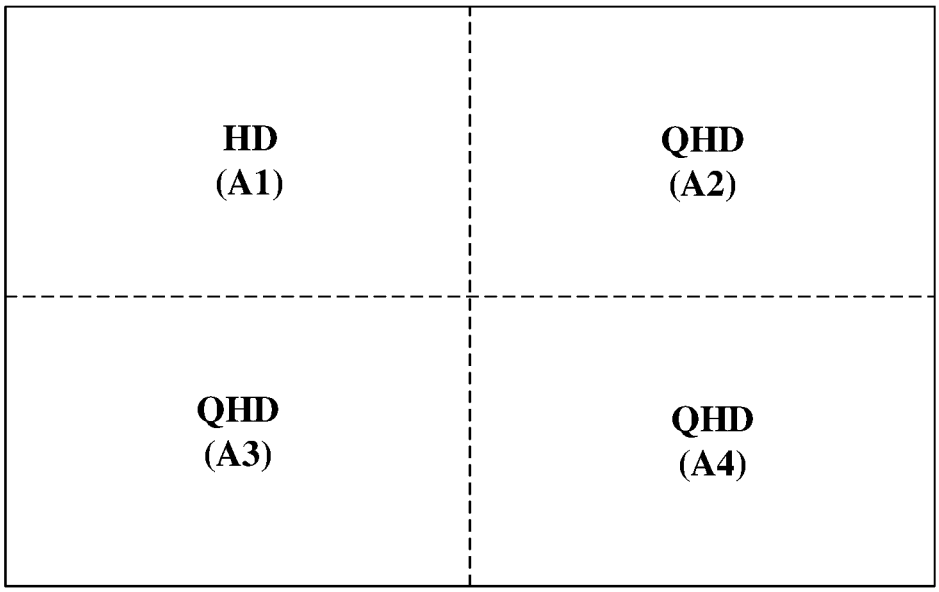
FIG. 9 is a schematic diagram of displaying different regions with different resolutions according to embodiments of the present disclosure.

For example, as shown in FIG. 9, when the A1 region of the display region does not need to be displayed in high resolution (for example, only text information is displayed), and the rest needs to be displayed in high resolution (for example, high-definition picture information is displayed), it is only necessary to switch the scan driving circuit 100 connected to the A1 region to the low resolution mode, and switch the scan driving circuit 100 connected to the A2, A3 and A4 regions to the high resolution mode.

It should be noted that, the dividing manners of the display region provided by the embodiments of the present disclosure includes, but is not limited to, the dividing manner as shown in FIG. 9. For example, the display region can also be divided into six display regions, eight display regions or more, which can be set as needed. In addition, the dividing manner in FIG. 9 is only schematic, the dividing regions are not limited to four regions having a same size, and can be inconsistent.

The array substrate provided by the embodiments of the present disclosure can change the display resolution and selectively drive the different display regions of the array substrate with different resolutions, thereby reducing the display power consumption.

Embodiments of the present disclosure also provide a display device, and the display device includes any one of the scan driving circuits provided by the above-described embodiments.

Figure 10:
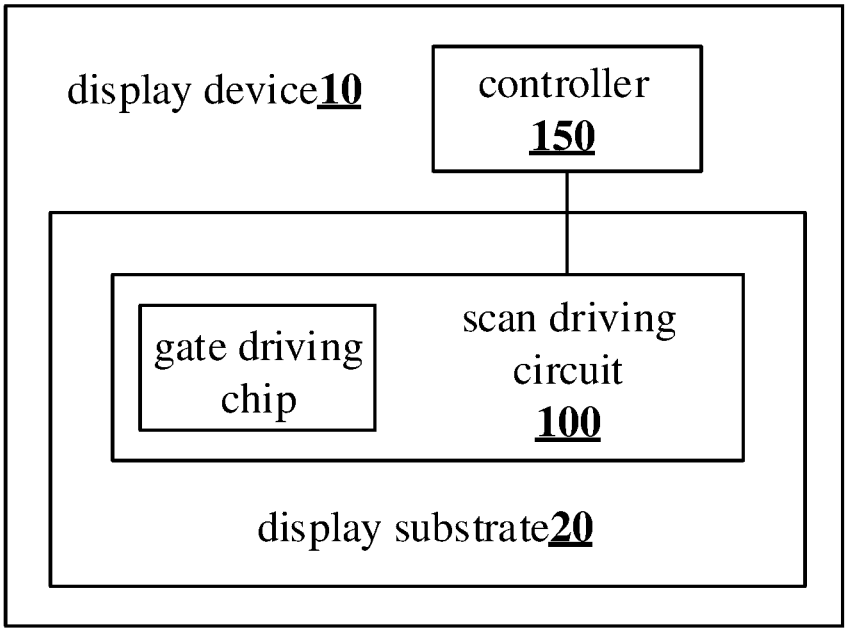
FIG. 10 is a schematic diagram of a display device according to embodiments of the present disclosure.

For example, as shown in FIG. 10, the display device 10 provided by the embodiment of the present disclosure can further include a display substrate 20. For example, the display substrate 20 can be an array substrate or another substrate (for example, an opposite substrate). In a case where the scan signal generating circuit is a gate driving chip, the gate driving chip is bonded and mounted on the display substrate 20. For example, in one example, the gate driving chip is bonded and mounted on the array substrate; and in another example, the gate driving chip is bonded and mounted on the opposite substrate, and connected to, for example, the switching circuits, the scan lines and the like formed on the array substrate.

As shown in FIG. 10, the display device 10 provided by the embodiment of the present disclosure can further include a controller 150. For example, with continued reference to FIG. 8, the controller 150 is connected to a plurality of switching circuits 110 in each of the scan driving circuit 100 so as to control the display resolution mode of each of the scan driving circuit 100. The controller 150 can also be connected to the scan signal generating circuit 120 to control the timing controller 140 in the scan signal generating circuit 120 for generating the progressive-scan signals.

For example, the timing controller 140 and the controller 150 can be respectively implemented by an application-specific integrated circuit chip and can also be implemented by a circuit or software, hardware (circuit), firmware or any combination thereof.

For another example, the timing controller 140 and the controller 150 can include a processor and a memory. In the embodiments of the present disclosure, the processor can process data signals and can include various computational structures, e.g., a complex instruction set computer (CISC) structure, and a reduced instruction set computer (RISC) structure or a structure that incorporates a plurality of instruction set combinations. In some embodiments, the processor can also be a microprocessor, e.g., an X86 processor or an ARM processor, and can also be a digital processor (DSP), etc. The processor can control other components to execute desired functions. In the embodiments of the present disclosure, the memory can store instructions and/or data executed by the processor. For example, the memory can include one or more computer program products. The computer program products can include various forms of computer readable storage media, e.g., volatile memory and/or nonvolatile memory. The volatile memory can include, for example, a random access memory (RAM) and/or a cache or the like. The nonvolatile memory can include, for example, a read-only memory (ROM), a hard disk, a flash memory, etc. One or more computer program instructions can be stored in the computer readable storage medium, and the processor can execute the program instructions to implement the desired functions (implemented by the processor) in the embodiments of the present disclosure. Various applications and various data, e.g., data used and/or generated by the applications can also be stored in the computer readable storage medium.

For another example, the controller 150 can be integrally formed with the timing controller 140, for example, the controller 150 and the timing controller 140 can be integrated in a circuit or a chip; or the controller 150 can be integrally formed with the scan signal generating circuit 120, for example, the controller 150 and the scan signal generating circuit 120 can be integrated in a circuit or a chip.

For example, the display device 10 can be an electronic paper, a mobile phone, a tablet computer, a television, a display, a notebook computer, a digital photo frame, a navigator and other products or members having display function.

It should be noted that the embodiments of the present disclosure do not limit the type of the display device, for example, the display device can include an LCD display panel, and can also include an OLED display panel.

The display device provided by the embodiment of the present disclosure can change the display resolution, and can further selectively drive the different regions of the display device with different resolutions, thereby display power consumption is able to be reduced.

Figure 11:
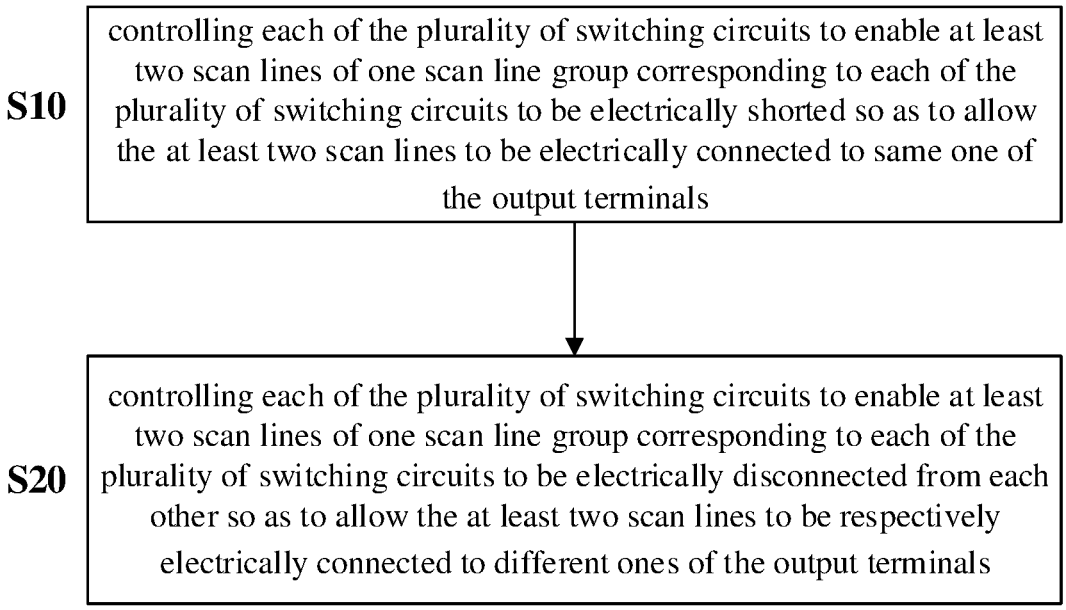
FIG. 11 is a flowchart of a driving method of a scan driving circuit according to embodiments of the present disclosure.

Embodiments of the present disclosure also provide a driving method of the scan driving circuit provided by the embodiments of the present disclosure. As shown in FIG. 11, the driving method includes the following steps.

Step S10: controlling each of the plurality of switching circuits to enable at least two scan lines of one scan line group corresponding to each of the plurality of switching circuits to be electrically shorted so as to allow the at least two scan lines to be electrically connected to same one of the output terminals; and Step S20: controlling each of the plurality of switching circuits to enable at least two scan lines of one scan line group corresponding to each of the plurality of switching circuits to be electrically disconnected from each other so as to allow the at least two scan lines to be respectively electrically connected to different ones of the output terminals.

For example, when it is necessary to switch to the low resolution mode, step S10 is performed; and when it is necessary to switch to the high resolution mode, step S20 is performed. The switching between the high resolution and the low resolution can refer to the corresponding descriptions in the above-described embodiments, and details are not described here again. The switching operation can be initiated, for example, by automatic judgment of a system, or can be initiated manually.

The driving method of the scan driving circuit provided by the embodiments of the present disclosure can change the display resolution of the display region connected to the scan driving circuit as needed, thereby reducing the display power consumption.

Figure 12:
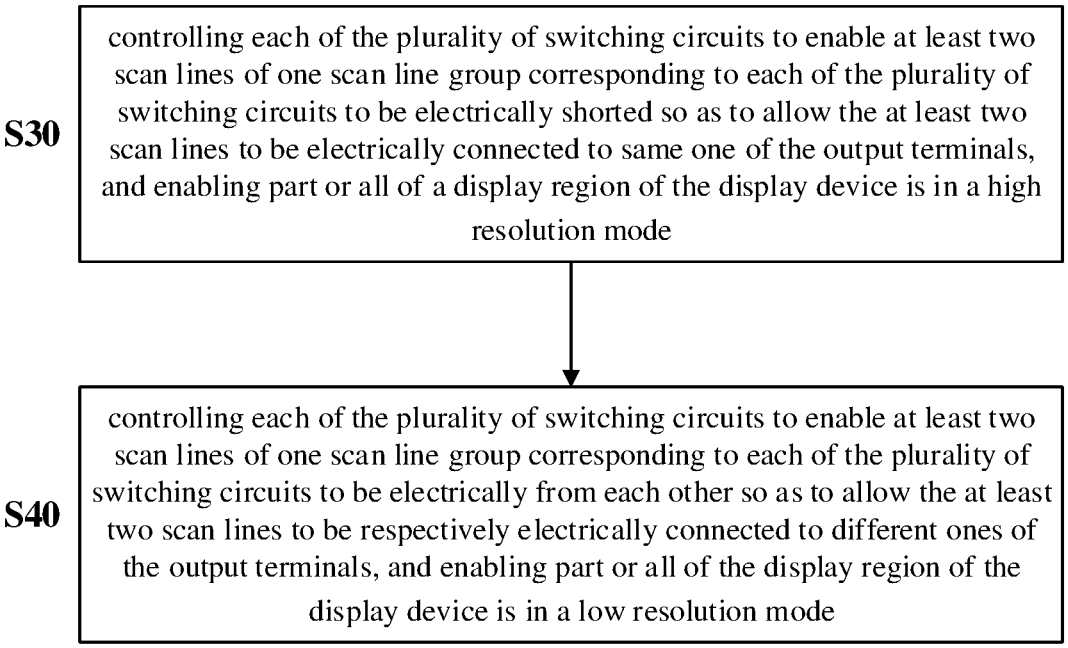
FIG. 12 is a flowchart of a driving method of a display device according to embodiments of the present disclosure.

Embodiments of the present disclosure also provide a driving method of the display device provided by the embodiments of the present disclosure. As shown in FIG. 12, the driving method includes the following steps.

Step S30: controlling each of the plurality of switching circuits to enable at least two scan lines of one scan line group corresponding to each of the plurality of switching circuits to be electrically shorted so as to allow the at least two scan lines to be electrically connected to same one of the output terminals, and enabling part or all of a display region of the display device is in a high resolution mode; and Step S40: controlling each of the plurality of switching circuits to enable at least two scan lines of one scan line group corresponding to each of the plurality of switching circuits to be electrically from each other so as to allow the at least two scan lines to be respectively electrically connected to different ones of the output terminals, and enabling part or all of the display region of the display device is in a low resolution mode.

For example, when it is necessary to switch part or all of the display region of the display device to the low resolution mode, step S30 is performed; when it is necessary to switch part or all of the display region of the display device to the high resolution mode, step S40 is performed. The switching between the high resolution and the low resolution can refer to the corresponding descriptions in the above-described embodiments, and details are not described here again. Similarly, the switching operation can be initiated, for example, by automatic judgment of a system, or can be initiated manually.

The driving method of the display device provided by the embodiments of the present disclosure can change the display resolution of the display device as needed and can selectively drive the different regions with different resolutions, thereby reducing the display power consumption.

What have been described above are only specific implementations of the present disclosure, the protection scope of the present disclosure is not limited thereto. The protection scope of the present disclosure should be based on the protection scope of the claims.

What is claimed is:

1. A scan driving circuit, comprising:

a scan signal generating circuit, a plurality of scan lines and a plurality of switching circuits, wherein the scan signal generating circuit comprises a plurality of output terminals for respectively outputting scan signals;

the plurality of scan lines respectively correspond to the plurality of output terminals of the scan signal generating circuit and are divided into a plurality of scan line groups, and each of the plurality of scan line groups comprises at least two scan lines;

the plurality of switching circuits respectively correspond to the plurality of scan line groups and are respectively disposed between the plurality of scan line groups and the plurality of output terminals;

each of the plurality of switching circuits is configured to enable at least two scan lines of one scan line group corresponding to each of the plurality of switching circuits to be electrically shorted so as to allow the at least two scan lines to be electrically connected to same one of the output terminals, or electrically disconnected from each other so as to allow the at least two scan lines to be respectively electrically connected to different ones of the output terminals;

each scan line group of the plurality of scan line groups comprises two scan lines, correspondingly, each of the plurality of switching circuits comprises:

a first input terminal, a first output terminal, corresponding to and being connected to the first input terminal.

a second input terminal, a second output terminal, corresponding to the second input terminal, a first switch, connected in series between the first input terminal and the second output terminal, and a second switch, connected in series between the second input terminal and the second output terminal;

wherein the first input terminal and the second input terminal are respectively connected to one of the plurality of output terminals of the scan signal generating circuit, and the first output terminal and the second output terminal are respectively connected to different one of the two scan lines of the scan line group.

2. The scan driving circuit according to claim 1, further comprising a first control signal line and a second control signal line, wherein the first control signal line is connected to a control terminal of the first switch, and the second control signal line is connected to a control terminal of the second switch.

3. The scan driving circuit according to claim 2, wherein the first switch comprises a first transistor, a first electrode of the first transistor is connected to the first input terminal, a second electrode of the first transistor is connected to the second output terminal, and a gate electrode of the first transistor is connected to the first control signal line and is served as the control terminal of the first switch; and the second switch comprises a second transistor, a first electrode of the second transistor is connected to the second input terminal, a second electrode of the second transistor is connected to the second output terminal, and a gate electrode of the second transistor is connected to the second control signal line and is served as a control terminal of the second switch.

4. The scan driving circuit according to claim 2, wherein the first control signal line and the second control signal line are electrically connected to each other.

5. The scan driving circuit according to claim 1, wherein the scan signal generating circuit comprises a GOA circuit, the GOA circuit comprises a plurality of cascaded GOA units, and each of the GOA units corresponds to one of the plurality of output terminals.

6. The scan driving circuit according to claim 1, wherein the scan signal generating circuit comprises a gate driving chip.

7. An array substrate, comprising the scan driving circuit according to claim 1.

8. A display device, comprising the scan driving circuit according to claim 1.

9. The display device according to claim 8, further comprising a display substrate and a controller, wherein in a case where the scan signal generating circuit comprises a gate driving chip, the gate driving chip is bonded on the display substrate; the controller is configured to control the plurality of switching circuits.

10. A driving method of the display device according to claim 8, comprising:

controlling each of the plurality of switching circuits to enable at least two scan lines of one scan line group corresponding to each of the plurality of switching circuits to be electrically shorted so as to allow the at least two scan lines to be electrically connected to same one of the output terminals, and enabling part or all of a display region of the display device is in a high resolution mode; and controlling each of the plurality of switching circuits to enable at least two scan lines of one scan line group corresponding to each of the plurality of switching circuits to be electrically from each other so as to allow the at least two scan lines to be respectively electrically connected to different ones of the output terminals, and enabling part or all of the display region of the display device is in a low resolution mode.

11. A driving method of the scan driving circuit according to claim 1, comprising:

controlling each of the plurality of switching circuits to enable at least two scan lines of one scan line group corresponding to each of the plurality of switching circuits to be electrically shorted so as to allow the at least two scan lines to be electrically connected to same one of the output terminals; and controlling each of the plurality of switching circuits to enable at least two scan lines of one scan line group corresponding to each of the plurality of switching circuits to be electrically disconnected from each other so as to allow the at least two scan lines to be respectively electrically connected to different ones of the output terminals.

12. A scan driving circuit, comprising:

a scan signal generating circuit, a plurality of scan lines and a plurality of switching circuits, wherein the scan signal generating circuit comprises a plurality of output terminals for respectively outputting scan signals;

the plurality of scan lines respectively correspond to the plurality of output terminals of the scan signal generating circuit and are divided into a plurality of scan line groups, and each of the plurality of scan line groups comprises at least two scan lines;

the plurality of switching circuits respectively correspond to the plurality of scan line groups and are respectively disposed between the plurality of scan line groups and the plurality of output terminals;

each of the plurality of switching circuits is configured to enable at least two scan lines of one scan line group corresponding to each of the plurality of switching circuits to be electrically shorted so as to allow the at least two scan lines to be electrically connected to same one of the output terminals, or electrically disconnected from each other so as to allow the at least two scan lines to be respectively electrically connected to different ones of the output terminals;

each scan line group of the plurality of scan line groups comprises three scan lines, correspondingly, each of the plurality of switching circuits comprises:

a first input terminal, a first output terminal, corresponding to and being connected to the first input terminal, a second input terminal, a second output terminal, corresponding to the second input terminal, a third input terminal, a third output terminal, corresponding to the third input terminal, a first switch, connected in series between the first input terminal and the second output terminal, a second switch, connected in series between the second input terminal and the second output terminal, a third switch, connected in series between the second output terminal and the third output terminal, and a fourth switch, connected in series between the third input terminal and the third output terminal;

wherein the first input terminal, the second input terminal and the third input terminal are respectively connected to one of the plurality of output terminals of the scan signal generating circuit, and the first output terminal, the second output terminal and the third output terminal are respectively connected to different one of the three scan lines of the scan line group.

13. The scan driving circuit according to claim 12, further comprising a first control signal line and a second control signal line, wherein the first control signal line is connected to a control terminal of the first switch and a control terminal of the third switch, and the second control signal line is connected to a control terminal of the second switch and a control terminal of the fourth switch.

14. The scan driving circuit according to claim 13, wherein the first switch comprises a first transistor, a first electrode of the first transistor is connected to the first input terminal, a second electrode of the first transistor is connected to the second output terminal, and a gate electrode of the first transistor is connected to the first control signal line and is served as the control terminal of the first switch;

the second switch comprises a second transistor, a first electrode of the second transistor is connected to the second input terminal, a second electrode of the second transistor is connected to the second output terminal, and a gate electrode of the second transistor is connected to the second control signal line and is served as the control terminal of the second switch;

the third switch comprises a third transistor, a first electrode of the third transistor is connected to the second output terminal, a second electrode of the third transistor is connected to the third output terminal, and a gate electrode of the third transistor is connected to the first control signal line and is served as the control terminal of the third switch; and the fourth switch comprises a fourth transistor, a first electrode of the fourth transistor is connected to the third input terminal, a second electrode of the fourth transistor is connected to the third output terminal, and a gate electrode of the fourth transistor is connected to the second control signal line and is served as the control terminal of the fourth switch.

15. The scan driving circuit according to claim 13, wherein the first control signal line and the second control signal line are electrically connected to each other.

16. An array substrate, comprising the scan driving circuit according to claim 12.

17. A display device, comprising the scan driving circuit according to claim 12.

18. A driving method of the display device according to claim 17, comprising:

controlling each of the plurality of switching circuits to enable at least two scan lines of one scan line group corresponding to each of the plurality of switching circuits to be electrically shorted so as to allow the at least two scan lines to be electrically connected to same one of the output terminals, and enabling part or all of a display region of the display device is in a high resolution mode; and controlling each of the plurality of switching circuits to enable at least two scan lines of one scan line group corresponding to each of the plurality of switching circuits to be electrically from each other so as to allow the at least two scan lines to be respectively electrically connected to different ones of the output terminals, and enabling part or all of the display region of the display device is in a low resolution mode.

19. A driving method of the scan driving circuit according to claim 12, comprising:

controlling each of the plurality of switching circuits to enable at least two scan lines of one scan line group corresponding to each of the plurality of switching circuits to be electrically shorted so as to allow the at least two scan lines to be electrically connected to same one of the output terminals; and controlling each of the plurality of switching circuits to enable at least two scan lines of one scan line group corresponding to each of the plurality of switching circuits to be electrically disconnected from each other so as to allow the at least two scan lines to be respectively electrically connected to different ones of the output terminals.

20. A driving method of a display device, the display device comprising a scan driving circuit, the scan driving circuit comprising a scan signal generating circuit, a plurality of scan lines and a plurality of switching circuits; the scan signal generating circuit comprising a plurality of output terminals for respectively outputting scan signals; the plurality of scan lines respectively corresponding to the plurality of output terminals of the scan signal generating circuit and being divided into a plurality of scan line groups, and each of the plurality of scan line groups comprising at least two scan lines; the plurality of switching circuits respectively corresponding to the plurality of scan line groups and being respectively disposed between the plurality of scan line groups and the plurality of output terminals; each of the plurality of switching circuits being configured to enable at least two scan lines of one scan line group corresponding to each of the plurality of switching circuits to be electrically shorted so as to allow the at least two scan lines to be electrically connected to same one of the output terminals, or electrically disconnected from each other so as to allow the at least two scan lines to be respectively electrically connected to different ones of the output terminals;

comprising:

controlling each of the plurality of switching circuits to enable at least two scan lines of one scan line group corresponding to each of the plurality of switching circuits to be electrically shorted so as to allow the at least two scan lines to be electrically connected to same one of the output terminals, and enabling part or all of a display region of the display device is in a high resolution mode; and controlling each of the plurality of switching circuits to enable at least two scan lines of one scan line group corresponding to each of the plurality of switching circuits to be electrically from each other so as to allow the at least two scan lines to be respectively electrically connected to different ones of the output terminals, and enabling part or all of the display region of the display device is in a low resolution mode.

* * * * *